United States Patent [19]

Tesan

[11] 4,068,610

[45] Jan. 17, 1978

[54] SKI PROPULSION POLES

[76] Inventor: Riccardo Tesan, 2397 Finch Ave. W., Weston, Canada

[21] Appl. No.: 747,666

[22] Filed: Dec. 6, 1976

[51] Int. Cl.[2] ..... B63H 16/04

[52] U.S. Cl. ..... 115/24.1; 115/22.1; 280/11.37 H; 9/310 A

[58] Field of Search ..... 280/11.37 H; 228/28 R, 228/28 A; 9/310 R, 310 A, 310 B, 40, 1.1; 135/66, 71; 115/21, 22.1, 24.1, 270

[56] References Cited

U.S. PATENT DOCUMENTS

| | | | |
|---|---|---|---|
| 3,313,265 | 4/1967 | Guin | 115/70 |
| 3,879,048 | 4/1975 | Penney | 280/11.37 A |

*Primary Examiner*—Trygve M. Blix

*Assistant Examiner*—D. W. Keen

*Attorney, Agent, or Firm*—Hirons & Rogers

[57] ABSTRACT

Manually operable ski propulsion poles or paddles, for use in water skiing or snow skiing or the like, are provided with a lower medium-engaging portion, an upwardly extending shaft, a handle at the upper portion of the shaft, and arm supporting means pivotally secured to the shaft and adapted to engage the arm of an operator gripping the handle. The arm supporting means may include biasing means such as a spring loading, urging the shaft in a direction towards the arm of the operator. Such arm supporting means materially reduce the effort necessary in operating the paddles, both during the propulsion stroke and during the return of the paddle to its initial position after a propulsion stroke.

10 Claims, 8 Drawing Figures

SKI PROPULSION POLES

FIELD OF THE INVENTION

This invention relates to manually operable propulsion poles or paddles, of the type used by a snow skier, water skier or operator of other self-propelled mobile structures.

BACKGROUND OF THE INVENTION

Water skis of the type which an operator attaches one to each foot and propels himself along by means of hand held paddles which are pushed against the water have been proposed in the past. The operation of previously proposed water skis and paddles, however, has required considerable agility and athletic ability on the part of the operator. They have required strenuous and energetic effort to operate, particularly for extended periods of time. This strenuous effort, coupled with problems of maintaining balance on the skis during the expenditure of such effort, has limited the appeal of this form of recreation.

BRIEF DESCRIPTION OF THE PRIOR ART

Various forms of self-propelled water skis and propulsion paddles therefor have been described in the prior art. In U.S. Pat. No. 3,027,576 Fines, for example, paddles are shown having a shaft and a buoyant watertight tank or cover secured to the bottom end of the pole, and having an open end of the tank or cover presented downwardly to the water. This same patent also proposes an umbrella-like form of cup or tank which collapses on upward movement through the water to facilitate withdrawal of the paddle from the water. U.S. Pat. No. 3,800,734 Whang, shows water propulsion paddles having valve arrangements in the lower, water engaging formation to facilitate water engagement of downward strokes and easy removal through the water on upward strokes. U.S. Pat. No. 3,313,265 Gain shows a water propulsion paddle having an open ended lower cup of elastic material. All the above proposed devices have been provided merely with a handle on the upper end of the shaft which the operator is required to grip firmly for operating purposes. These handles simply comprise the upper part of the shaft, so that operation of the paddles is wholly dependent on firm grip and muscular effort on the part of the operator.

SUMMARY OF THE INVENTION

The present invention has as an object the provision of improved paddles or poles for use in combination with water skis, snow skis or the like for self propulsion.

A further object of the invention is to provide water ski propulsion paddles which require reduced effort on the part of the operator for effective use and control.

Other objects and advantages will becom apparent from the following description.

Briefly, the present invention provides a propulsion pole or paddle of the above type which includes a lower medium-engaging portion, a shaft extending upwardly from said medium-engaging portion, a handle at the upper portion of the shaft, and arm supporting means pivotally secured to the shaft for angular movement relative thereto substantially in a single plane, said arm supporting means also being adapted to releasably engage the arm of an operator when gripping the handle.

One of the chief difficulties in the operation of the operation of the propulsion poles or paddles with water skis or snow skis is the maintenance of proper directional control of the poles during operation. Optimum propulsive thrust can only be exerted with the poles, if they are properly directionally controlled, and operated in line with the operator's arm. Further, directional control of the poles in operation enhances the ease with which the operator can turn and manoeuver on the skies, since the operator has greater control over the direction of downward force on the poles.

DESCRIPTION OF THE PREFERRED EMBODIMENTS

It has been found that a very significant factor in the effort necessary to operate water propulsion paddles of this type is the effort expended in the lifting of the paddles and withdrawal thereof through the water, at the end of a propulsion stroke. During the course of an operating stroke, the disposition of the paddles relative to the water surface and the operator's body changes, from an initial position where the paddles extend downwardly at an acute angle to the vertical, and at which the operator exerts downward and forward thrust on the paddles for propulsion against the water, to a final position at the end of the stroke where the paddles are disposed in a much more horizontal position, and are in fact well behind the position of the operator's body. To prepare for the next complete stroke, the operator must return the paddles close to his body, at or close to the surface of the water, and in a more upright disposition. This must be done either by dragging the paddles back through the water, which requires considerable effort and detracts from the propulsive force of the previous stroke, or by lifting the paddles clear of the water surface and returning them to the position for the next stroke. This lifting also requires significant muscular effort, because of the relative disposition of the operator's arm and the ski at the end of the stroke, and also because of the water resistance.

Another significant factor in the operating effort is the relative change of angular position between the paddles and the operator's arm during the propulsion stroke. As noted, from the beginning to the end of the propulsion stroke, the angle of the paddle shaft changes to a more horizontal position, so that it effectively moves upwardly towards the operator's arm. Such lifting movement is resisted by the water, and requires muscular effort by the operator to overcome.

The paddles of the present invention include arm support means which bias the paddle towards the operator's arm. This materially assists the operator, both in making the propulsion stroke and in withdrawing the paddle from the water at the end of the stroke, to return it to the initial position for the next propulsion stroke. The paddles are thus less strenuous to operate, allowing the operation to continue for longer periods of time, and permit the operator better to control the paddles throughout their cycle of operation, and hence better to control his balance on the skis during operation.

The preferred ski paddle according to the invention has an arm supporting means having an arm engaging formation at one end adapted to be releasably secured to the operator's fore arm above the wrist, and a pivotal connection to the shaft of the ski paddle at the other end. Suitably the arm supporting means has length adjusting means such as a sliding connection of parts or telescopic portion in its length, so that its length is adjustable during operation, precluding the necessity of the operator's changing the position of his grip on the handle during the stroke. The biasing means, which is suitably a spring, may be provided in the telescopic portion, or associated with the pivotal connection of the arm supporting means to the shaft.

In another preferred embodiment, particularly adapted for use with water skis, the lower part of the shaft has at least one plate member hingedly mounted relative to the shaft, for movement between a first open position in which the plate member lies in a plane disposed at 130°–180° angle to the direction of the longitudinal axis of the shaft, and a second closed position in which the plate member lies in a plane disposed at an acute angle to or substantially parallel to the direction of the longitudinal axis of the shaft. By this means, the paddle presents a large bottom surface area for pushing against the water during the propulsion stroke, but collapses to provide a reduced surface area during upward movement through the water on the return stroke, to facilitate return movement of the paddle. In this arrangement, the lower part of the shaft is suitably provided with a transversely extending hinge pin, to which are hingedly mounted two similar plate members in mutually opposed relationship, for hinging movement relative to one another and relative to the shaft between the first, open position and the second, collapsed position.

BRIEF REFERENCE TO THE DRAWINGS

In the drawings, like reference numerals indicate like parts.

DETAILED DESCRIPTION OF THE SPECIFIC PREFERRED EMBODIMENTS

Figure 1:
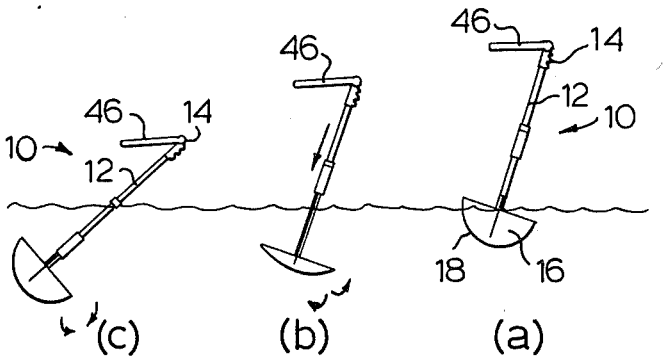
FIG. 1 is a diagrammatic illustration of the operation of a water ski paddle according to the invention, showing the disposition of the paddle at various stages of operation.

With reference to FIG. 1, as the paddle 10 enters the water for a propulsion stroke, the shaft portion 12 thereof is disposed in a generally upright position, as shown at (*a*). The upper end of the shaft 12 is provided with a handle 14 in the form of an apertured formation which the operator can grip, and arm supporting means 46 to be described in more detail below. The lower end of the paddle 10 is provided with a pair of hinged plates 16, 18, which form a lower medium-engaging portion, hingedly movable between a closed position, to which they are biased, shown in FIG. 1(*a*), and an open position shown in FIG. 1(*b*), in which the plates 16, 18 are disposed at an angle of about 150° to one another. During a propulsion stroke, the operator exerts downward force on the paddle 10 and the plates open to increase the thrust against the medium, namely water. Then the paddle 10 assumes the position shown in FIG. 1(*b*).

At the end of the propulsion stroke, the shaft 12 of the paddle 10 assumes an angle as shown in FIG. 1 (*c*), i.e., more horizontal with respect to the water surface, and has moved upwardly with respect to the operator's arm. As the operator attempst to lift the paddle 10 out of the water at the end of the propulsion stroke, with forward movement through the water, the plates 16, 18 close against the water resistance and under the urging of their biasing. The plates 16, 18 do not close completely, so as to be sure that the water resistance will cause them to open on the next propulsion stroke. At the open position, the plates 16, 18 form an angle of about 150° to each other, so that the maximum water propulsion force can be exerted against water resistance concentrated at and directed towards the location under the bottom end of the shaft 12.

Figure 2:
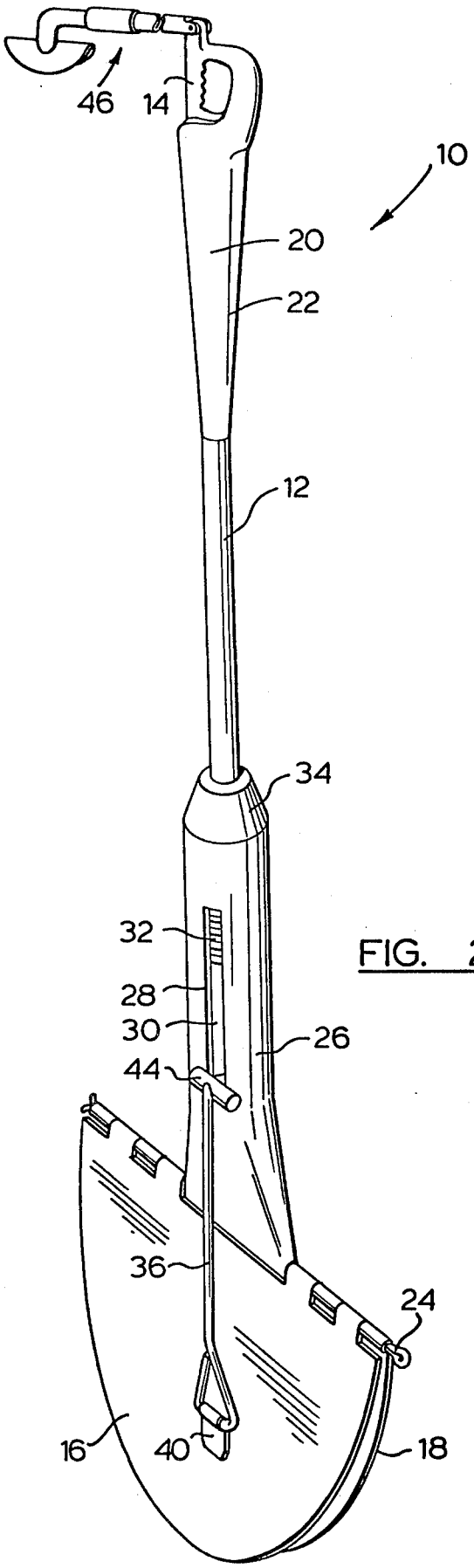
FIG. 2 is a perspective view of a paddle of FIG. 1, in the closed position.

With reference to FIG. 2, the paddle 10 has an intermediate upwardly extending shaft 12, which at its upper end has a hollow, thickened portion 20 which is generally eliptical in transverse cross section presenting a forward ridge 22. A handle formation 14 is provided at the top of portion 20. The thickened upper portion 20 of the shaft 12 increases the buoyancy of the paddle. A hinge pin 24 extends transversely of the longitudinal axis of the shaft 12, on each side of the lower part of shaft 12. Two similar generally semi-circular plate members 16, 18 are provided in mutually opposed relationship, pivotally mounted on each side of the hinge pin 24.

At its lower end, the shaft 12 is received in a housing sleeve 26. The housing sleeve 26 is provided with opposed longitudinally extending slots 28, one at each side. The shaft 12 inside the housing sleeve 26 is provided with a longitudinal sliding collar 30. The upper end of collar 30 carries a coil spring 32, which is received at its upper end inside a tapered formation 34 at the upper end of the housing sleeve 26. The spring 32 urges the collar 30 downwards and provides biasing means for the plates 16, 18 towards the open position. This is accomplished by the provision of hinged tie rods 36, 38 pivotally connected at their respective lower ends 40, 42 to the respective plates 16, 18. At their upper ends, the tie rods 36, 38 are pivotally connected by means of hinge formations 44 to the slidable collar 28, through the slots 30.

Figure 4:
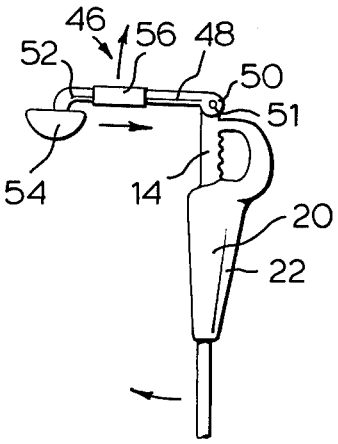
FIG. 4 is a detail, somewhat diagrammatic, of the upper part of a paddle or pole according to the present invention, in a first position of operation.
Figure 5:
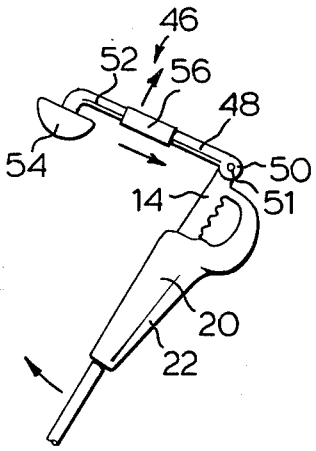
FIG. 5 is a view similar to FIG. 4 showing the paddle in a second position of operation.
Figure 6:
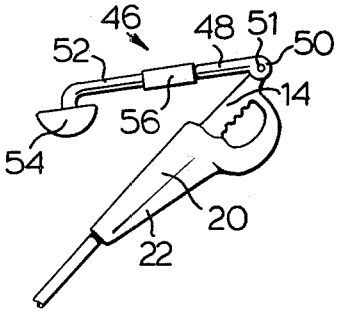
FIG. 6 is a view similar to FIG. 4 and FIG. 5 showing the paddle in a third position of operation.

The upper end of the paddle 10 is provided with biased arm supporting means, one form of which is shown diagrammatically in FIGS. 4, 5 and 6. In this form, the arm supporting means 46 includes a first shaft portion 48 which is pivotally connected by a pivot formation 50 to the upper extremity of the handle 14 of the paddle 10. The arm supporting means 46 also includes a second shaft portion 52 having releasable arm engaging bindings 54 at one end, and a connecting sleeve 56 in which the adjacent ends of the first and second shaft portions 48, 52 are slidably connected so that the arm supporting portion 46 as a whole is telescopic and hence of varying length.

The pivot formation 50 comprises cooperating cylindrical formations one associated with the shaft 48 and one with the upper extremity of the handle 14, arranged side by side and pivotally connected by means of a pivot pin 51. The cylindrical formations enclose a coil spring anchored at one end in one of the cylindrical formation, and at the other end in the other cylindrical formation, so tthat relative rotation therebetween alters the tension of the coil spring. Conveniently, the cooperating sides of the cylindrical formations are provided with stop members which limit the degree of relative rotation therebetween, substantially to the angle between the positions of the arm supporting means 46 in FIGS. 4 and 6. Such an angle limiting arrangement facilitates the initial securing of the arm supporting means 46 to the operator's arm.

FIG. 4 shows this embodiment of the invention with the parts disposed substantially in the position at the start of a downward and rearward propulsion stroke. The arm engaging bindings 54 would engage an operator's forearm, above the wrist and below the elbow, in a secure, non-slipping manner, and the operator grips the handle formation 14 in his hand, to exert downward and rearward propulsive force on the shaft. At this position, the length of the arm supporting member 46 is at its shortest. As the propulsive stroke continues, the parts move to the relative positions shown in FIG. 5, in which the shaft 12 of the paddle points more towards the rear, the operator having rotated his wrist to accommodate this change of angle. This lengthens the distance between the top pivot formation 50, located above the operator's hand gripping handle 14, and the position on the operator's forearm gripped by the arm engaging bindings 54, so that the arm supporting member 46 telescopically expands. The biasing coil spring in pivot formation 50 assists this angular change between the paddle 10 and the arm supporting member 46. Further downward and rearward propulsive stroke brings the parts to the relative position shown in FIG. 6, where the paddle 10 is disposed angularly closer to the arm supporting member 46, with consequent telescopic lengthening of the arm supporting member 46. The operator's wrist has turned further to bring the parts to the FIG. 6 position, and the spring biasing of pivot 50 has assisted this movement. The paddle 10 in this position is withdrawn through the water and lifted back to the start of a new propulsion stroke.

Figure 7:
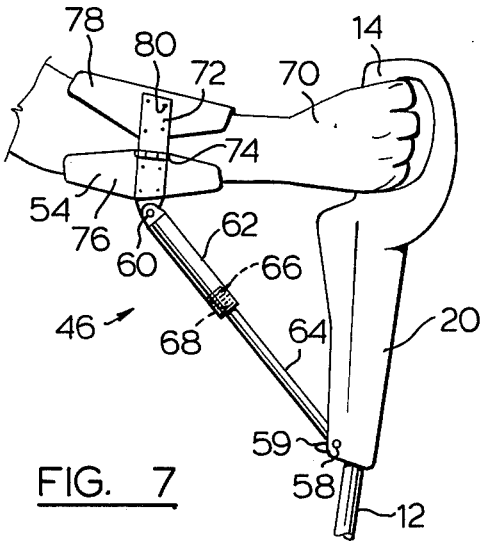
FIG. 7 is a detail, somewhat diagrammatic, of the upper part of an alternative form of paddle or pole according to the invention, in a first position of operation.
Figure 8:
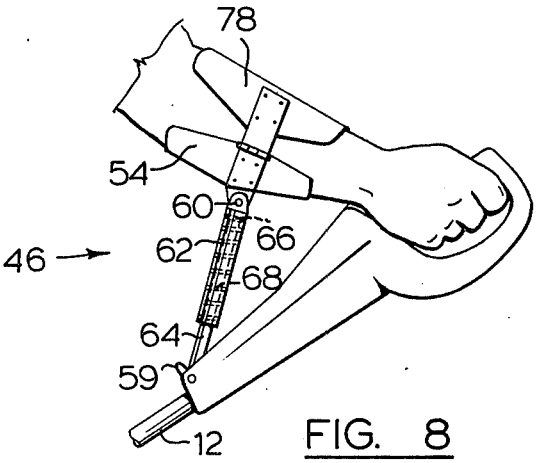
FIG. 8 is a view similar to FIG. 7 showing the paddle in a second position of operation.

An alternative form of biased arm supporting means is shown diagrammatically in FIGS. 7 and 8. In this embodiment, the arm supporting means 46 is pivotally connected at the lower end to a pivot 58 at the bottom end of thickened portion 20 of the shaft 12. A stop formation 59 projects outwardly from the thickened portion 20, which will engage the arm supporting means 46 when out of use and prevent its falling downwardly about pivot 58. This greatly assists in mounting the arm supporting means 46 on an operator's arm ready for use. At its upper end, the arm supporting means 46 is pivotally connected at 60 to the releasable arm engaging means 54. The arm supporting means 46 comprises an upper, hollow, cylindrical portion 62, and a lower rod portion 64 which is slidably received inside the cylinder 62 at its upper end. The rod 64 terminates at its upper end in a flange 66 which is slidable inside the cylinder 62 but prevents total withdrawal of the rod 64 from the cylinder 62. A coil spring 68 is located around the upper end of rod 64, inside the cylinder 62, between flange 60 and the lower end of cylinder 62, which urges the rod 64 upwardly inside the cylinder 62.

In this embodiment, the arm engaging means 54 comprise a part circular rigid strap 72 which is hingedly connected at 60 to the upper end of the cylinder 62. The strap 72 is pivotally connected at 74 to a lower arm binding 76. An upper arm binding 78 is provided, fixed to the upper, arcuate portion of strap 72 by rivets 80, the strap 72 extending a short way over the top surface of upper arm binding 78. The The lower arm binding 76 and the upper arm binding 78 are releasably secured together, at the side remote from strap 72, by suitable releasable snap-open fastener, so that the arm engaging means 54 will be released from the operator's arm 70 in the event of a fall.

In the position shown in FIG. 7, the parts are disposed for the start of a downward and rearward propulsion stroke. The operator's hand 70 grips the handle portion 14 and the shaft 12 extends largely vertically downwards, with the arm supporting means 64 extended, compressing spring 68. During the stroke, the parts move to the position shown in FIG. 8, with the shaft 12 raised towards the operator's arm, the rod 64 moving up inside cylinder 62 assisted by spring 68, contracting the length of the arm supporting means 46.

Figure 3:
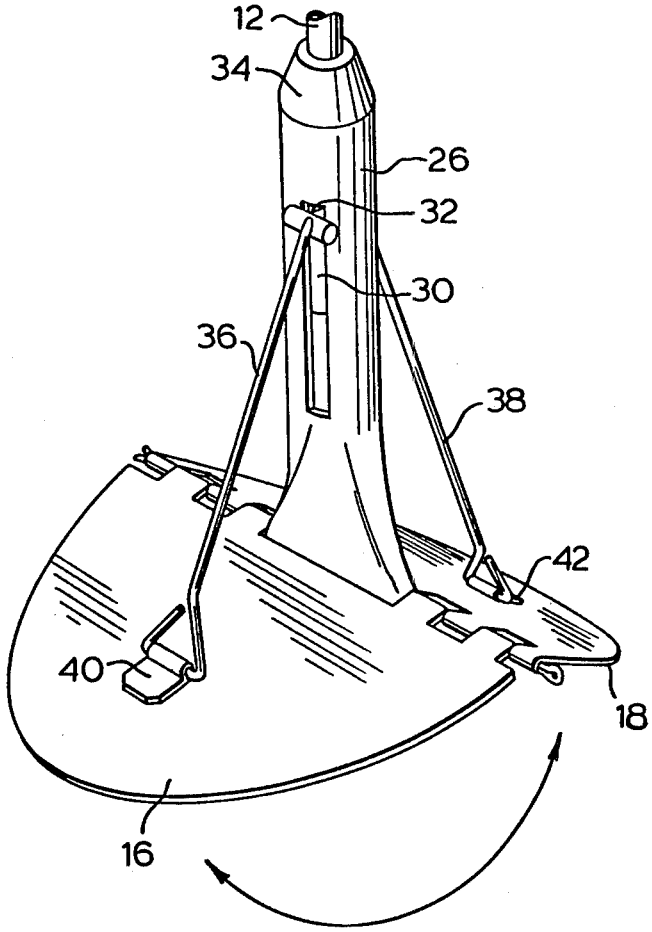
FIG. 3 is a perspective view of the bottom end of the paddle of FIG. 2, in the open position.

During the downward movement of a propulsion stroke, the bottom portion of the paddle 10 moves from the relative position of parts shown in FIG. 2 to the disposition shown in FIG. 3. The resistive force of the water causes the plates 16, 18 to separate and hinge about the hinge pin 24, taking up their opened, large surface presenting position shown in FIG. 3. In this movement, tie rods 36, 38 hinge at their bottom ends about pivotal connections 40, 42 to the respective plates, and about the upper hinges 44 by means of which they are connected to slidable collar 30 inside the housing sleeve 26. The collar 30 is thus moved upwardly inside the sleeve 26, about shaft 20, against the urging of compression spring 32 located inside housing sleeve 26. Thus the parts assume the position shown in FIG. 3. The upward travel of collar 30 within housing sleeve 26 is limited by full compression of the spring 32, so as to define and limit the fully open position of the plates 16, 18. When the downward propulsive force on the shaft 12 is stopped, and the paddle is withdrawn upwardly through the water, the plates 16, 18 collapse and return to the positions shown in FIG. 2, assisted by the urging of the coil spring 32 urging the collar 30 downwardly within the housing sleeve 26.

In the specific embodiments illustrated and described herein, the arm supporting means is pivotally secured to the shaft, in such a manner that it can move angularly relative to the shaft substantially in a single plane only. Thus the operator has angular control of the pole and can maintain it for operation substantially in line with his arms, for maximum effect.

It will be appreciated that other arrangements of the arm supporting means, biasing means therefor, and mechanisms for effecting desired action of the lower portion of the paddles can be adopted, within the scope of the present invention. For example, there are other possible locations and modes of operation of the biasing means which urges the arm supporting means upwardly. It could, for instance, comprise a compression spring mounted generally parallel to the upper part of the shaft, and urging downwardly against a part of the arm supportion means adjacent the pivoted connection thereof to the shaft, but on the other side of the pivot from the arm engaging means, so as to urge the arm supporting means upwardly. The embodiments illustrated and described in detail are by way of example only, the scope of the invention being limited only by the appended claims. Moreover, it will be appreciated that paddles according to the invention, whilst described with specific reference to their application to water skis are applicable in a variety of other modes in which an operator propels himself along by means of thrust exerted by the operator against a medium, for example snow skiing, canoeing, roller conveyances such as skate boards and roller skates, road skis and the like.

What I claim is:

1. A propulsion pole or paddle for use by an operator in self-propulsion on a mobile conveyance relative to a medium, said paddle including a lower portion for engaging the medium on propulsive thrust;

a shaft extending upwardly from said lower portion and having at its upper portion a handle adapted to be gripped by the hand of an operator;

an arm supporting means pivotally secured to said shaft for angular movement relative thereto substantially in a single plane, and including biasing means urging the shaft in a direction towards the arm of the operator when gripping said handle, said arm supporting means also being adapted to releasably engage the arm of an operator when the operator grips said handle.

2. The pole of claim 1 wherein said arm supporting means includes length adjusting means, and is pivotally secured at one end thereof to said shaft.

3. The pole of claim 2 wherein said arm supporting means includes releasable arm bindings adapted to releasably engage the operator's forearm, in non-sliding manner, said arm bindings being located at one end of the arm supporting means remote from its pivotal connection to the shaft.

4. The pole of claim 3 wherein said arm supporting means is pivotally connected to said shaft by means of a pivotal connection located above the handle, said biasing means urging the shaft towards the operator's arm being disposed in said pivotal connection.

5. The pole of claim 3 wherein said arm supporting means is pivotally connected to said shaft by means of a pivotal connection located below the handle, said arm bindings being pivotally connected to a telescopic portion of said arm supporting means.

6. The pole of claim 5 wherein said arm supporting means comprises a lower rod, the lower end of which is pivotally connected to said shaft, and an upper, hollow cylinder, the upper end of said lower rod being slidably received in said cylinder, and a coil spring constituting said biasing means being located in said cylinder between the upper end of said lower rod and the lower end of the cylinder and urging the rod upwardly inside the cylinder.

7. The pole or paddle of claim 3 wherein the lower portion for engaging the medium includes at least one plate member associated with the shaft, said plate member being hingedly mounted relative to the shaft for hinging movement between a closed position in which the plate member lies in a plane close to parallel with the direction of the longitudinal axis of the shaft, and an open position in which the plate member lies in a plane closer to perpendicular to the direction of the longitudinal axis of the shaft.

8. The paddle of claim 7 including a hinge pin extending transversely of and secured to a lower portion of the shaft, and two similar plate members each hingedly mounted on said hinge pin in mutually opposed relationship, for hinging movement relative to one another and relative to the shaft between said open and closed second positions.

9. The paddle of claim 8, including stop means for limiting the relative hinging movement of the plate members between said open and said said closed positions, and biasing means urging said plate members towards their closed position.

10. The paddle of claim 3, including stop means for limiting the pivoted movement between the shaft and the arm supporting means.

* * * * *